United States Patent [19]

Imbert

[11] 4,087,093

[45] May 2, 1978

[54] GAME APPARATUS WITH MULTIPLE BOARDS

[76] Inventor: Leon Alfred Imbert, 1937 Darrah St. No. 24, Ceres, Calif. 95307

[21] Appl. No.: 717,685

[22] Filed: Aug. 25, 1976

[51] Int. Cl.[2] ..... A63F 3/00

[52] U.S. Cl. ..... 273/243; 273/274

[58] Field of Search ..... 273/130 H, 134 C, 134 CB, 273/134 CA, 134 CH, 134 D, 134 DB, 86 A

[56] References Cited

U.S. PATENT DOCUMENTS

| | | | |
|---|---|---|---|
| D. 42,924 | 8/1912 | Moss | 273/86 A |
| 1,628,073 | 4/1926 | Sousa | 273/134 CH |
| 3,170,697 | 2/1965 | Banks et al. | 273/135 AC |
| 3,913,919 | 10/1975 | Carpenter | 273/130 H |

FOREIGN PATENT DOCUMENTS

| | | | |
|---|---|---|---|
| 1,006,568 | 10/1965 | United Kingdom | 273/134 CH |
| 624,595 | 6/1949 | United Kingdom | 273/134 CB |

*Primary Examiner*—Robert W. Michell
*Assistant Examiner*—Arthur S. Rose
*Attorney, Agent, or Firm*—J. L. Bohan

[57] ABSTRACT

A game board apparatus comprising a central betting board and individual playing cards containing thereon a rectangular pathway for the movement of individual player tokens. The number of spaces an individual player may move his token on his card during his turn is established by chance by combining the values shown on the face of a standard playing card and dice. Chips, and script dollars are allocated to each player at the beginning of the game and the object is for one player to acquire all the chips and script money from all the rest of the players.

2 Claims, 7 Drawing Figures

GAME APPARATUS WITH MULTIPLE BOARDS

BACKGROUND OF THE INVENTION

1. Field of the Invention

The present invention relates to game board apparatus which includes a central betting board and individual playing cards containing a pathway for tokens, movements of which tokens are established by chance through a combination of values showing on a standard deck of cards and playing dice.

2. Description of the Prior Art

Numerous game board apparatus exist comprising a single game board containing a rectangular course of travel for player pieces. These game boards necessarily require that all the game action take place on a single board.

Two examples of prior art employing the single board concept is that such as the C. B Darrow patent issued on Dec. 31, 1935, as U.S. Pat. No. 2,026,082. This board entails a rectangular course of travel over which the tokens of each individual opponent must pass during the course of the game.

Another example of a similar type of single board game is that shown in U.S. Pat. No. 2,780,463 issued to I. Salomon on Feb. 5, 1957, which contains an involuted pathway or course over which the individual markers or tokens pass in the course of the game.

Some games have a common rectangular course over which most of the game is played but then provide a final course taking the player to a final goal or "home" by means of a particular path over which exclusive travel belongs only to that particular player. A game board of this nature is shown in U.S. Pat. No. 3,104,106 issued to J. T. Kenney, et al, on Sept. 17, 1963.

The number of spaces that an individual player may move his token or player piece in any one move is frequently arrived at by means of a single device which will produce a number by chance thereby allowing the player to move his token a corresponding number of spaces on the game board. These devices are well known and usually involved a spinner, dice or cards. The game apparatus of the present invention calls upon employment of at least one deck of standard playing cards containing fifty-two cards and one or more die.

The game apparatus of the present invention employs a central betting board which also contains the unplayed decks of standard playing cards and, in addition, is employed in combination with the individual playing cards which are held in the possession of each individual player.

SUMMARY OF THE INVENTION

A preferred embodiment of the present invention utilizes a central playing board containing three centrally located spaces upon which three complete decks of cards containing fifty-two standard playing cards each, may be placed face down. Along several edges of this central playing card six spaces are provided for the placement of the betting chips during the course of the game. Six individual playing cards are provided so that each opponent will have one card in his possession on which his tokens or playing pieces will pursue a generally rectangular course.

The basic objective is for each player to go around the rectangular course of spaces or dots four times with his playing token before any of the other players. Four additional dots are contained inside the rectangular course for the purpose of keeping track of how many times a player has traversed the rectangular course of dots or spaces. Each time he passes the beginning dot or space he places a scorekeeping token over one of the inside spaces or dots in order to record that he has in fact made one complete turn around the rectangular course. Once all four of the inside spaces or dots are covered with the record keeping tokens, that particular player has won the round of the game. He is entitled at that point to take all the chips and/or paper money located at the central betting board that has been played in the course of betting from all the rest of the players. That is not the end of the game, however, as a new round begins and each round will continue until one player has all the betting chips and scrip money of all the other players in the game. A betting "occasion" occurs at the beginning of a round and each time a player passes the starting space or dot. Only call betting is allowed and no raises are permitted. A person need not bet when he passes the starting dot if he so chooses. However, he must call each bet made by others or drop out of the game. The game is played by each player in turn, rolling the single die, and then removing one of the face down cards from his choice of any one of the three decks of cards located on the central betting board. The difference between the die and the card is the number of spaces which that player may move. If he rolls a 3 on the die and he draws a face down card which is a 3 of Diamonds, his token remains on the same space, since he is allowed to move no spaces due to the fact that 3 minus 3 is 0. In this game Aces count as 1 and face cards count as 10 in the calculation of the difference between that number appearing on the face of the die and that appearing on the card drawn from the central betting board. Once the player has moved his token on his individual playing card the appropriate number of spaces, the card drawn from the central betting board is discarded face up in the space provided for that particular deck of cards on the individual playing card. The game continuouly calls upon the arithmetic exercise of substraction thereby developing the subtraction skills of the players.

DETAILED DESCRIPTION

Figure 1:
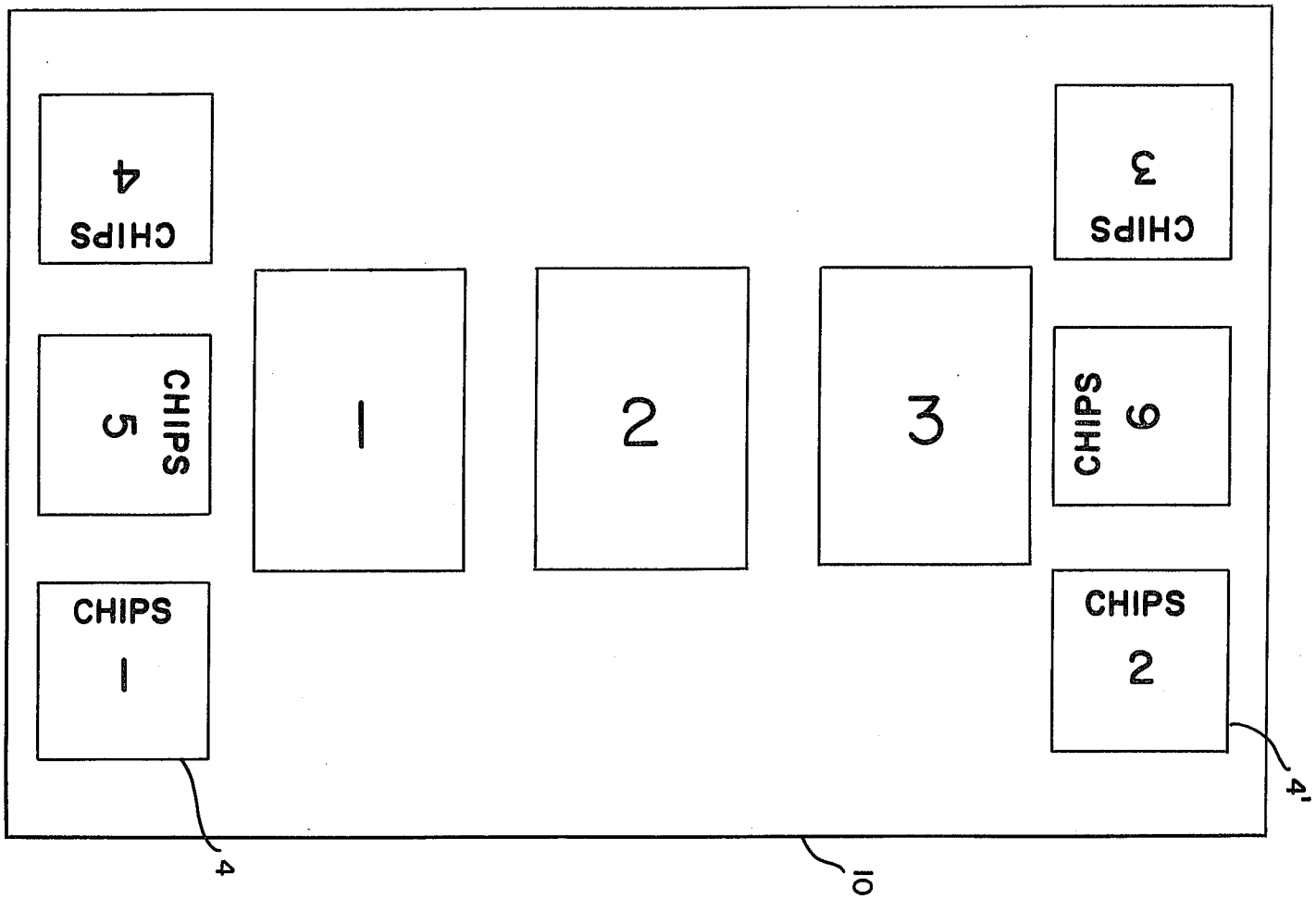
FIG. 1 is a Plan view, on a reduced scale, illustrating the preferred form of the central betting board of the game apparatus of the present invention.

Referring by numerals to the accompanying drawings, which illustrate a preferred embodiment of the game apparatus of the present invention, in FIG. 1 there is shown the central betting board 10 which contains along the central portion thereof three spaces 1, 2 and 3 for containing three full decks of cards in a face down configuration. Along two edges of the central betting cards are six spaces 4 provided for the placement of chips during the course of betting in the game.

Figure 2:
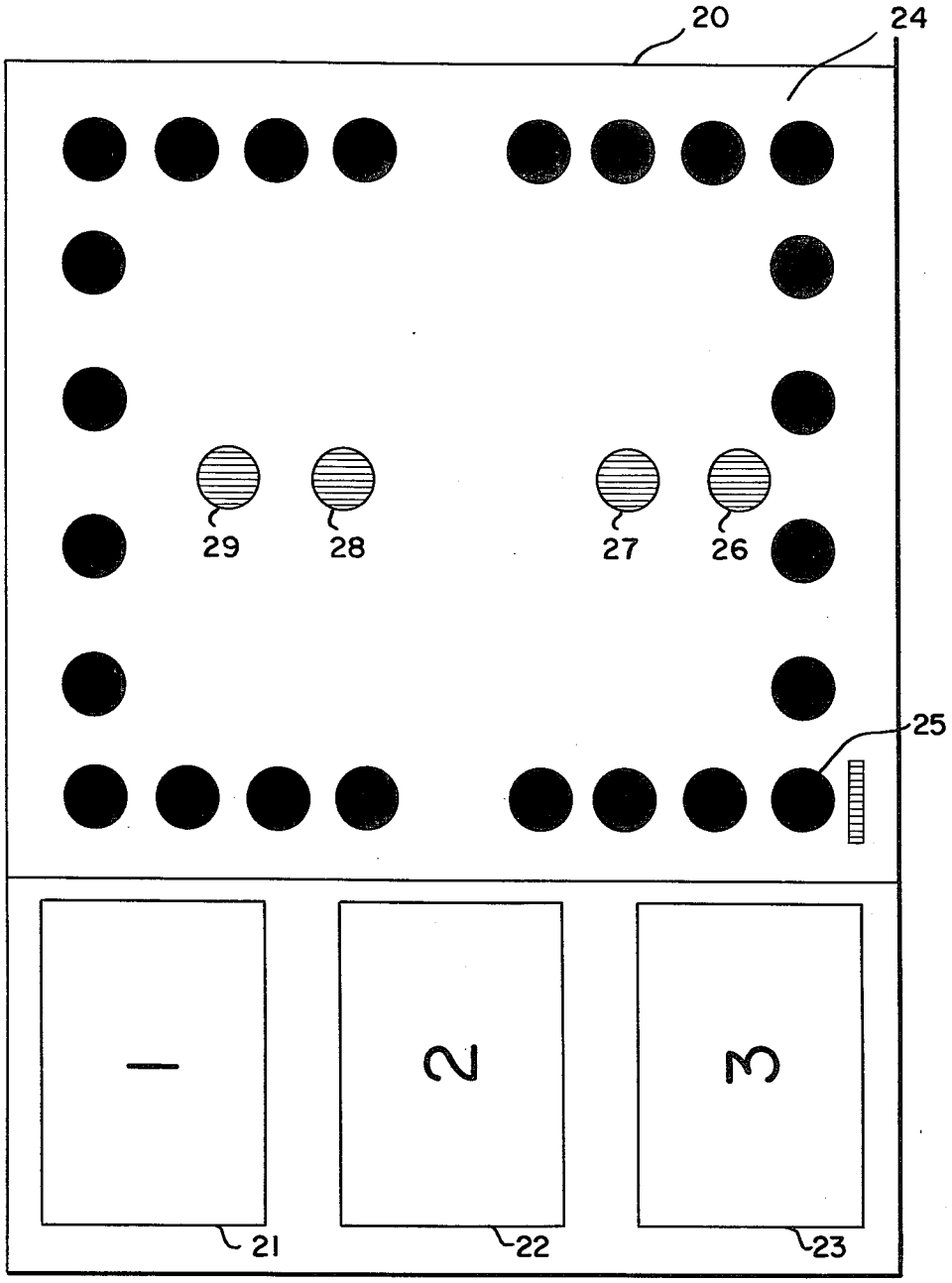
FIG. 2 is a Plan view of the individual playing card on a reduced scale, of a preferred embodiment of the present invention.

In FIG. 2 there is shown the individual playing card 20 which has three spaces 21, 22 and 23 corresponding to the spaces for placing discarded cards drawn from the playing decks located on the central betting board 10. On individual playing card 20 there is located adjacent to the area for the three stacks of discarded cards a course 24 containing twenty-four dots arranged in a generally rectangular configuration. The first dot 25 is the beginning point of the game, and at the start of the game each player places his token 30 on this beginning dot 25. The playing token 30 is then moved to one of the other twenty-three dots in accordance with a number arrived by chance through the die and the playing cards in the central betting board. Four other dots 26, 27, 28 and 29 are located inside the rectangular course for the purpose of maintaining a score of how many times the token 30 has passed around the rectangular course 24.

At the beginning of each round of the game, and each time a player passes the beginning dot 25, a betting occasion occurs wherein a player may place any number of chips and/or paper money or script on his respective betting square 4 contained on the central betting card 10. For example, player No. 1 will play his chips on rectangular space 4, and player No. 2 will place his chips on rectangular space 4', and so on. Generally, a maximum of six players may join in on the game and as few as two can play the game. Accordingly, this requires each game kit to have one central betting board 10, six individual playing cards 20 and six playing tokens or pieces. In addition, twenty-four marking or recording pieces 31 of different color are required so that each player may have four for the purpose of recording the number of times his rectangular course 24 has been traversed. In addition, a game kit contains 294 betting chips, comprising 150 white chips of a value of $1.00, 72 blue chips having a value of $5.00, and 72 red chips having a value of $10.00. Also included is play money having a total value of $1,200.00, consisting of 150 $1.00 bills, 90 $5.00 bills, and 60 $10.00 bills.

Figure 3:
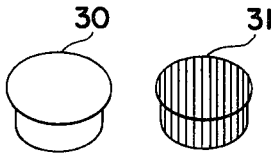
FIG. 3 is a perspective view of the symbols or tokens that are used by the several players in moving over the rectangular course on the individual playing cards and also used, in a different color, for recording the number of times the rectangular course is traversed.
Figure 4:
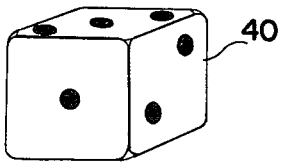
FIG. 4 represents in perspective the die used in the course in determining the number of spaces a player may move.
Figure 6:
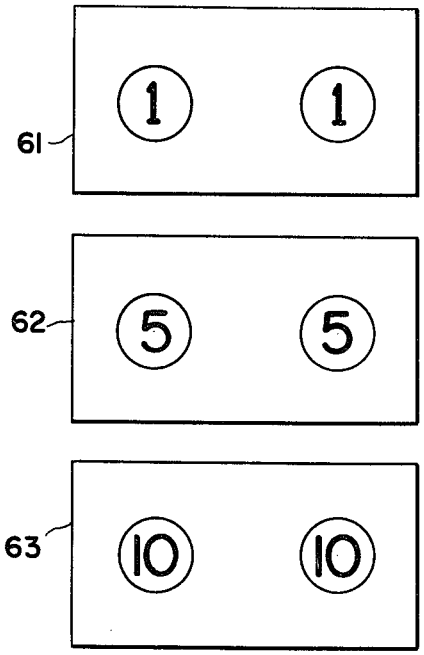
FIG. 6 is a view of the play or scrip money used in denominations of $1.00, $5.00 and $10.00.
Figure 7:
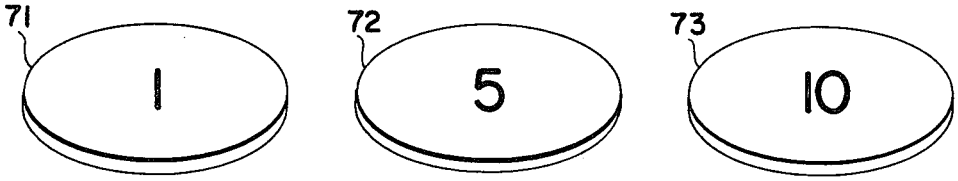
FIG. 7 is a perspective view of the chips used in denominations of $1.00, $5.00 and $10.00.

Accordingly, at the beginning of each game, each player is issued one individual playing card 20, one moving token 30, four black marking tokens 31 as shown in FIG. 3, 49 betting chips consisting of 25 white, 12 red, and 12 blue chips shown as 71, 72 and 73 in FIG. 7. In addition, play money having a total value of $200.00, consisting of 25 $1.00 bills, 15 $5.00 bills, and 10 $10.00 bills shown as 61, 62 and 63 in FIG. 6, are distributed to the participating players.

In order to better understand a preferred embodiment of the game apparatus of the present invention, the following rules are set forth.

THE RULES

Figure 5:
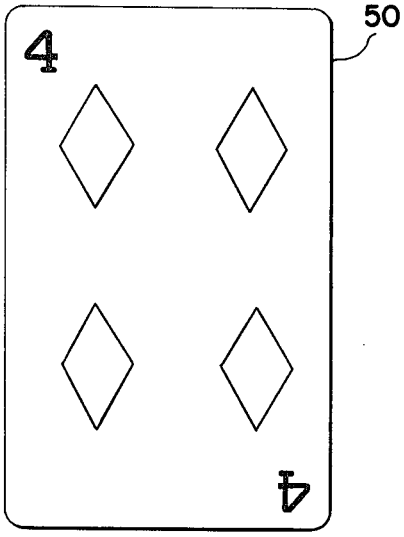
FIG. 5 shows a typical playing card from a deck of standard cards which also is used for determining the spaces a player may move.

The central betting board 10 is placed in the center of the playing area and three decks of standard playing cards are placed in the spaces marked 1, 2 and 3. During the course of the game, each player may draw a card such as 50 shown in FIG. 5 from whichever deck of cards he chooses, and after each play he discards the card in the appropriately marked space on his individual playing card 20.

Each player places his moving token 30 on the beginning dot or space 25 in the rectangular course 24. The players roll the dice to determine who will start the game and the playing order of the other players. In the case of a tie, the players continue to roll the dice until the tie is broken. The player with the highest roll is entitled to start the game. The other players follow in clockwise rotation.

The beginning player who starts out the game places one or more betting chips on his betting number on the central betting board 10. At this time, the other players must match his bet in order to stay in the game. They are not, however, allowed to raise the bet. To begin the game, the beginning player rolls the die 40 and then draws a card from one of the three decks in the central betting board 10. He takes the difference between the number showing on the face of the die 40 and the number showing on the face of the card. The smallest number, whether it be on the die or on the card, is subtracted from the other number. Aces count as one point, and all face cards count as ten points in calculating the number of spaces the player is entitled to move by virtue of his rolling his die 40 and having taken one card from the central betting board 10. The player discards the card in the appropriate space on his individual playing card 20 and moves his token 30 the appropriate number of spaces along the rectangular course of travel 24.

The players continue taking turns, rolling the die 40, drawing the cards and moving their tokens 30 in a clockwise direction around the rectangular course 24 until a player reaches or passes the beginning space or dot 25. The player then marks the first time around the rectangular course 24 by placing a record keeping piece 31 on the first dot 26 located in the central portion of the individual playing card 20. This player can at that point either bet the number of chips he so desires by placing them on his respective betting square, such as, 4 located on the central betting board 10. If the player so desires, he may pass and bet no chips or money at this point. Once this player places his bet, all the other players must match the bet in order to remain in the game.

A player may drop out of the game at any time by not placing a betting chip on his betting number when any player places a bet. When the player drops out and there are three or more players, his chips which have been betted previously remain on the board 10 until there is a winner. Chips and scrip not yet betted are returned to the bank. Once there is a winner, then the winner collects all the money on the card, including that of all those who have dropped out.

Every time a player reaches or passes the beginning dot 25 in the rectangular course 24, a record keeping token 31 is to be placed on the next consecutive dot 27, 28 and 29 on his individual playing card 20, and if, on the fourth round, the winner lands the playing token 30 exactly on the starting dot 25, that player receives not only the winnings located on the central betting board 10, but, in addition, each player remaining in the game must pay an amount to the winner equal to the last bet made just prior to the win. The player who is first to complete the four rounds wins the game and collects all the betting chips on the betting squares.

Before the next game goes into play, the cards must be collected from the individual playing cards 20 and placed back into the central betting board 10. The player who was the farthest behind in the previous round must shuffle the cards and replace them in their respective playing positions on the central betting board 10.

The game continues until one player has all the chips and script money of all the rest of the players.

It will be appreciated from the foregoing description that the game apparatus herein described presents a preferred embodiment and a variety of alternatives may be employed. For example, the number of betting spaces on the central betting board may be increased to over six spaces. In addition, the number of spaces for the playing cards may be increased four, or more. Likewise, a pair of dice or additional dice may be used in order to arrive at the number of spaces that may be moved and, of course, the number of spaces in the rectangular course 24 may be increased or decreased by any appropriate number. Likewise, the number of times that one has to pass around the rectangular course may be varied.

Having thus described one illustrative embodiment of the invention, it is to be understood that although specific terms are employed, they are used in a generic and desciptive sense and not for purposes of limitation, the scope of the invention being set forth in the following claims.

I claim:

1. In a game apparatus comprising a central betting board having six marked betting spaces and three marked areas for the placement of three decks of standard playing cards, a plurality of identical, individual playing cards each having three marked spaces for discarding said standard playing cards, a predetermined number of marked movement spaces for a closed-end route of travel extending about said card for the purpose of continuous play, and four marked spaces for placement of a record keeping token for recording each time a moving token completes one full lap around said closed-end route of travel, playing tokens for movement about said route of travel, three decks of standard playing cards for placement on said marked areas on said central betting board, one die, marking tokens, betting chips and play money, wherein the number of spaces travelled by said playing tokens along said route of travel is determined by taking the difference between the value obtained by rolling the one die and the value shown on a card drawn from one of the decks of standard playing cards.

2. In a game apparatus as in claim 1 wherein the predetermined number of marked movement spaces forming a closed-end route of travel extending about each of the individual playing cards is twenty-four spaces.

* * * * *